US006101850A

United States Patent [19]

Ma Dalmau Guell

[11] Patent Number: 6,101,850

[45] Date of Patent: Aug. 15, 2000

[54] SYSTEM FOR THE SELECTION OF NEEDLES FOR A CIRCULAR KNITTING MACHINE

[75] Inventor: Jose Ma Dalmau Guell, Barcelona, Spain

[73] Assignee: Jumberca, S.A., Barcelona, Spain

[21] Appl. No.: 09/167,583

[22] Filed: Oct. 7, 1998

[30] Foreign Application Priority Data

Oct. 7, 1997 [ES] Spain ..... 9702083

[51] Int. Cl.[7] ..... D04B 9/00

[52] U.S. Cl. ..... 66/221; 66/227

[58] Field of Search ..... 66/8, 216, 218, 66/219, 220, 221, 224, 222, 225, 226, 227

[56] References Cited

U.S. PATENT DOCUMENTS

| | | | |
|---|---|---|---|
| 3,855,819 | 12/1974 | Sawazaki | 66/221 |
| 4,036,033 | 7/1977 | Jesson | 66/14 |
| 4,615,187 | 10/1986 | Schimko | 66/75.2 |
| 5,072,603 | 12/1991 | Tenconi | 66/222 |
| 5,168,730 | 12/1992 | Conti | 66/222 |
| 5,323,627 | 6/1994 | Lonati et al. | 66/221 |

*Primary Examiner*—Danny Worrell
*Attorney, Agent, or Firm*—Nath & Associates; Gary M. Nath; Gregory B. Kang

[57] ABSTRACT

Needle selection system for a circular machine for knitted fabrics, constituted by an assembly which comprises a series of movable elements correspondingly related to respective stationary elements, the movable assembly including a cylinder (2) with numerous longitudinal grooves (3) distributed on the exterior contour, with the incorporation, in each groove (3), of a needle (1) and three successive positionable elements (6), (11) and (17), which determine the movement of the needle (1); while the stationary part includes respective actuating cams (5), (10), (12) and (25), which determine the actuation of the abovementioned positionable elements of the movable portion, as a function of the revolution of the cylinder (2).

1 Claim, 3 Drawing Sheets

SYSTEM FOR THE SELECTION OF NEEDLES FOR A CIRCULAR KNITTING MACHINE

In circular knitting machines, the fabric is produced by an assembly of needles, conventionally mounted in rotating needle beds, in functional relation to corresponding stationary portions.

The needles are functionally actuated by the selection of cams which act on the said needles, leading them selectively along alternative trajectories appropriate for the pattern which is to be knitted, so that each needle is selected in each case in order to follow a determined trajectory.

For this purpose, a system of needle selection for the abovementioned machines is proposed according to the present invention, based on rotating means and on stationary means which are mutually related in order to obtain, in each of the machine's stitch formation systems, three possibilities of movement or trajectory for each one of the needles.

This system, the subject of the invention, is based on an assembly formed by a series of movable parts correspondingly related to respective stationary parts, comprising in the movable assembly a cylinder with numerous longitudinal grooves distributed around its external contour, in each of which grooves there is included a needle and three successive positionable elements which determine the movement of the needle, there being in the stationary part, corresponding actuating cams which determine the actuation of the above-mentioned positionable elements of the movable part, as a function of the rotation of the cylinder.

Among the elements of the movable assembly is included an elastically deformable jack in the form of a balance, with two positions controlled by the action of a system of magnetic attraction, which is in opposition to an elastic portion of the said element and acts in the opposite direction, the said element being capable of adopting a tilting movement with respect to the magnetic system and another of displacement in the longitudinal direction of the cylinder, when it becomes detached from the magnetic system, in order to transmit the said displacement to another, intermediate jack, which in its turn presses on an elastic jack relating to the mobility of the needle.

In the stationary assembly, each of the stitch forming systems comprises a needle actuating cam, a cam for actuating the elastic jack, and a cam for actuating the intermediate jack, as well as two electromagnetic selection systems and two cams for actuating the elastically deformable jack, in conjunction with a presser cam which maintains tangential continuity in the whole perimeter of the machine.

An essentially simple assembly is thus obtained which is capable of providing effective functioning in order to determine with absolute precision the selection of the needle movement, in the functional actuation of the machine, in accordance with the fabric to be produced.

DETAILED DESCRIPTION

Figure 1:
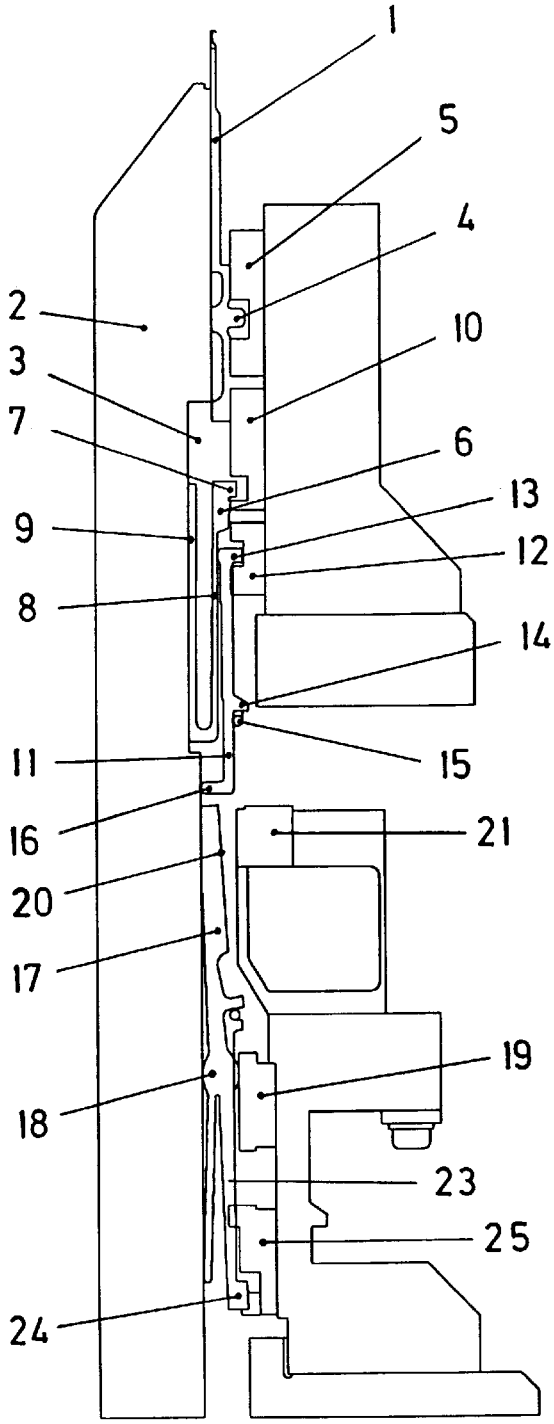
FIG. 1 shows a cross section of the assembly of the prior art system, in a given situation of the functional behavior.

The invention has as its object a needle selection system for circular knitting machines for the production of knitted textiles, with the purpose of permitting, in each of the operative stitch formation systems by the machine, three movement or trajectory possibilities for each one of the corresponding needles (1).

The system comprises a movable part formed by a cylinder (2) provided with longitudinal grooves (3) regularly distributed on the external contour, the following elements being included in each groove (3):

A needle (1) provided with a heel (4) which projects from the groove (3), inserted into a corresponding opposed actuating cam (5).

An elastic jack (6), in the shape of a hairpin, provided with a heel (7) which projects beyond the cylinder (2) when in a state of rest and which is concealed in the groove (3) when the exterior branch (8) is elastically positioned by external pressure against the interior branch (9); the said heel (7) being inserted in an opposed cam (10), in the first case, and outside of the same, in the second case.

An intermediate jack (11) which interacts with a corresponding actuating cam (12) by means of a heel (13), and furthermore equipped with a projection (14) which is in abutment with a compression spring (15). On the far end from the heel (13), the said intermediate jack (11) has a projection (16) directed toward the cylinder (2), with which it rests in the groove (3).

A selection jack (17), provided with a convex prominence (18) on both sides, in the central portion, the interior part of which rests in the bottom of the groove (3), and the exterior part of which rests against a presser cam (19). The upper portion of this jack (17) furthermore determines a planar face (20) by means of which it interacts with an electromagnetic selection system (21); while in the lower portion an interior foot (22) is defined and rests with its end on the bottom of the groove (3); and an exterior foot (23) forming a hairpin shape with it, and having a heel (24) by means of which it interacts with opposing cams (25).

This assembly of the system comprises a stationary part which, in relation to each of the stitch forming systems in the machine, includes a cam (5) for actuation of the needles (1), a cam (10) for actuation of the elastic jack (6), a cam (12) for actuation of the intermediate jack (11), two electromagnetic selection systems (21), two cams (25) for actuating the selection jack (17) and the presser cam (19) which maintains tangential continuity in the whole contour of the machine.

Figure 2:
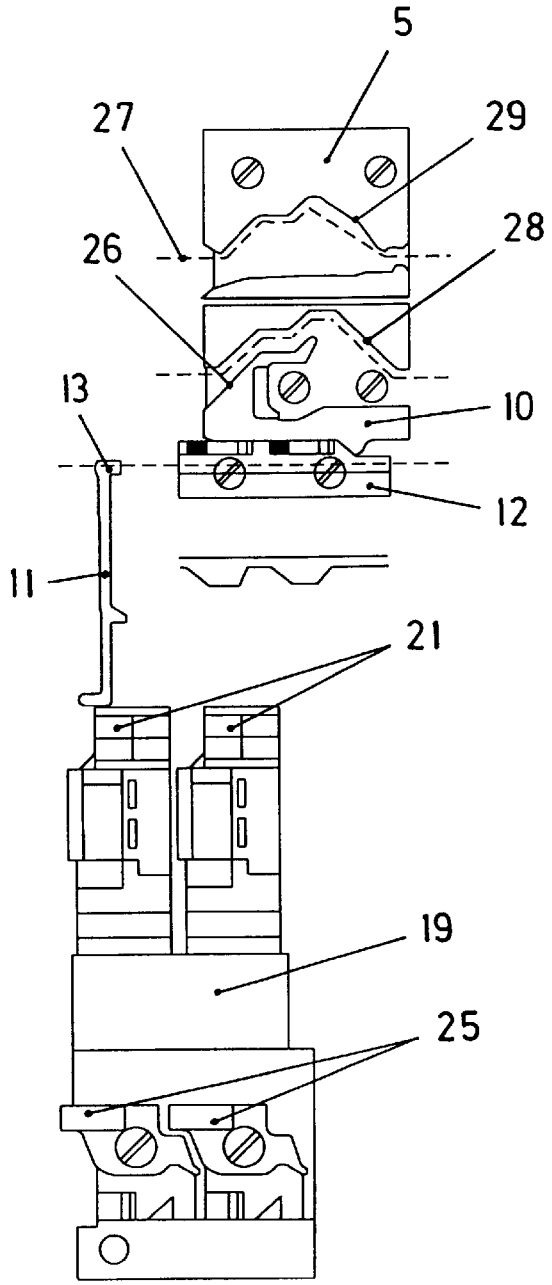
FIG. 2 is a front view from the interior of the machine, of the stationary parts of the system, in relation to the functional situation of the previous figure.

The intermediate jack (11) can adopt two working height positions, so that in the low position, according to FIGS. 1 and 2, the heel (13) does not interact with the cam (12) and maintains its radial position. In this position, the elastic jack (6) is maintained in its rest position, so that the ramp (26) of the cam (10) pushes it upward, with the needle (1) accompanying its displacement. In these circumstances, the needle (1) describes the trajectory (27) which is necessary to detach the stitch and form a new one; by following each of the cams (10) and (5) by means of the respective ramps (28) and (29), at the needle (1) and at the heel (13), in the descent to the low position disposed to begin another cycle.

Figure 3:
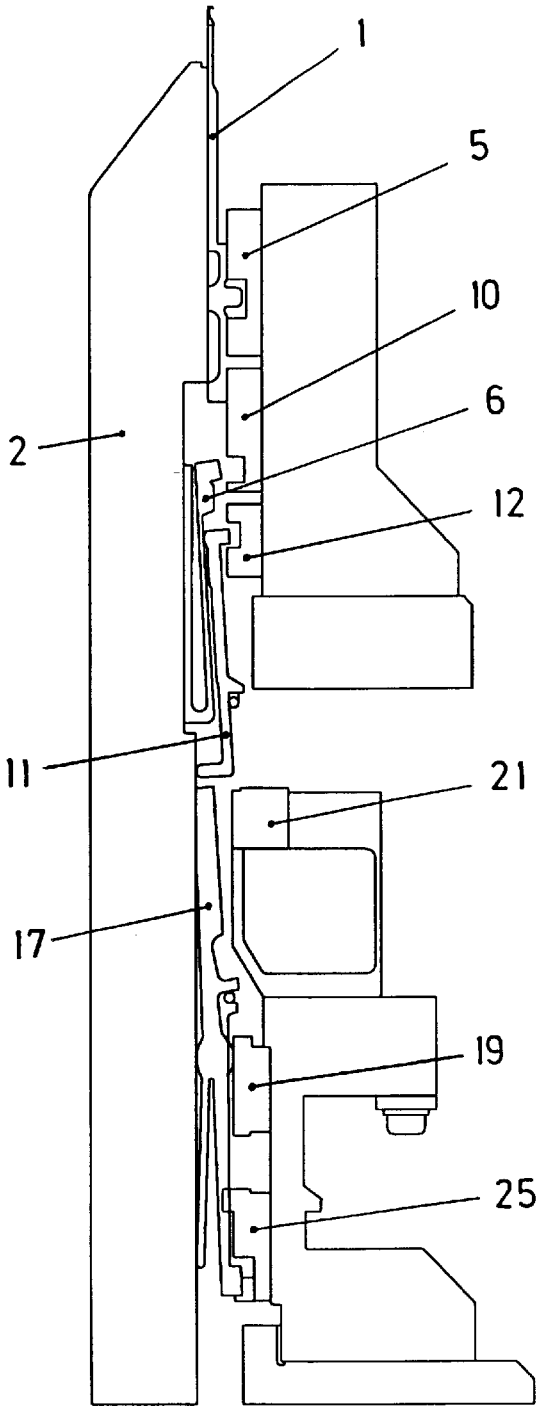
FIGS. 3 and 4 and FIGS. 5 and 6 are diagrams, corresponding to those of FIGS. 1 and 2, in other specific situations of the functional behavior of the system.
Figure 4:
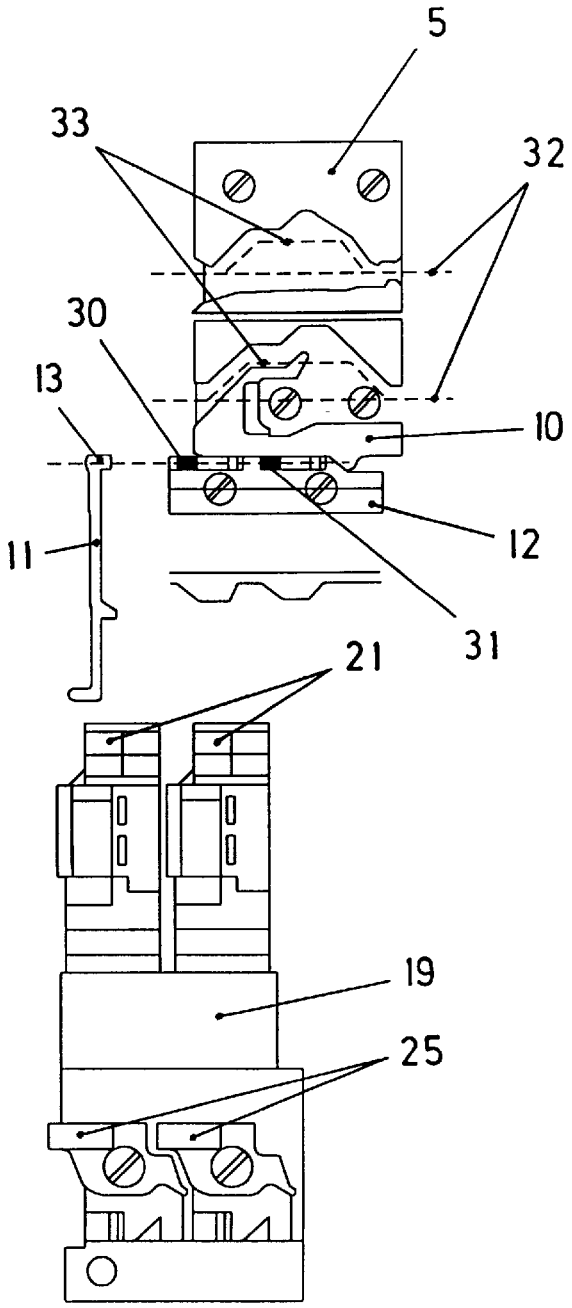

When the intermediate jack (11) adopts the high position, according to FIGS. 3 and 4, its heel (13) is opposite to the radial ramps (30) and (31) which push it toward the interior of the cylinder. (2), in turn pushing the elastic jack (6) and thereby preventing its being able to be led by the cam (10).

The intermediate jack (11) can adopt this high position in two different tangential situations of the cam system, in order to be pushed respectively by the ramps (30) and (31);

so that in the more advanced situation it is pushed by the ramp (30), with the elastic jack (6) remaining in its low position, whereby the needle (1) follows a straight trajectory (32). In this case, the needle (1) does not receive yarn and does not form a stitch (which is termed "cancellation selection").

In the more retrograde situation, the said intermediate jack (11) is pushed by the ramp (31), upon which the elastic jack (6) is compelled toward the interior of the cylinder (2) in the middle of its lifting trajectory, relinquishing the needle (1) in the middle of its trajectory (33). In this case, the needle (1) does not detach the stitch and receives yarn (which is termed "selection of loaded stitch").

Figure 5:
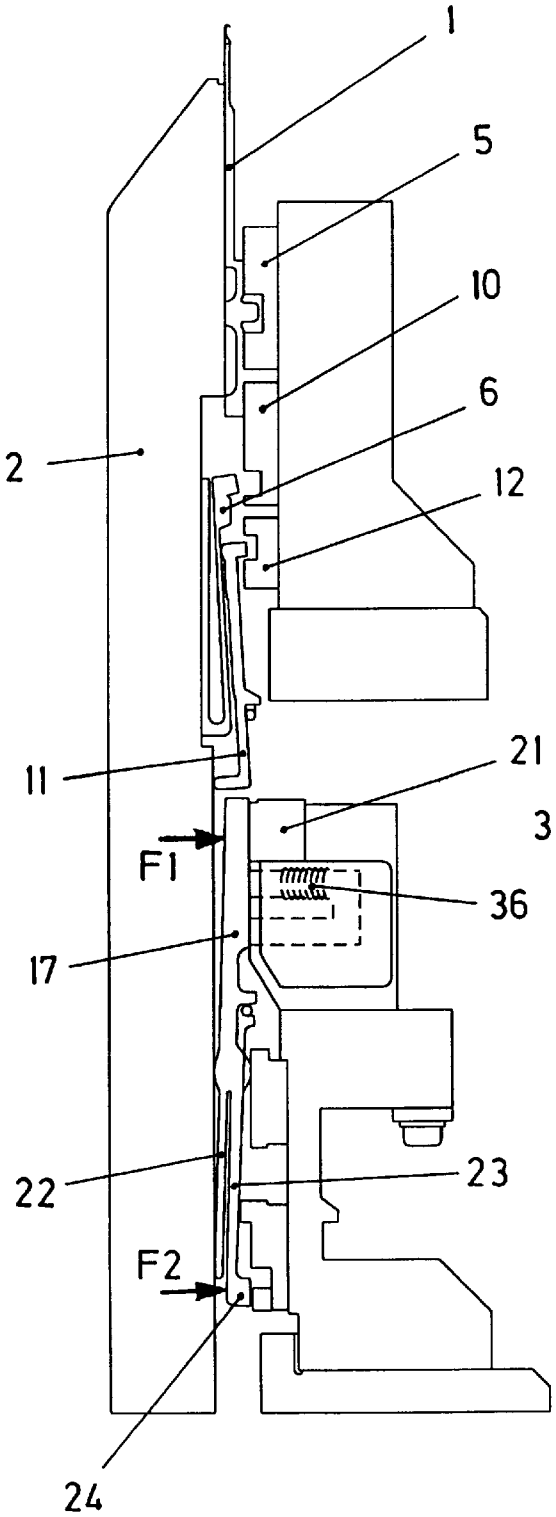
Figure 6:
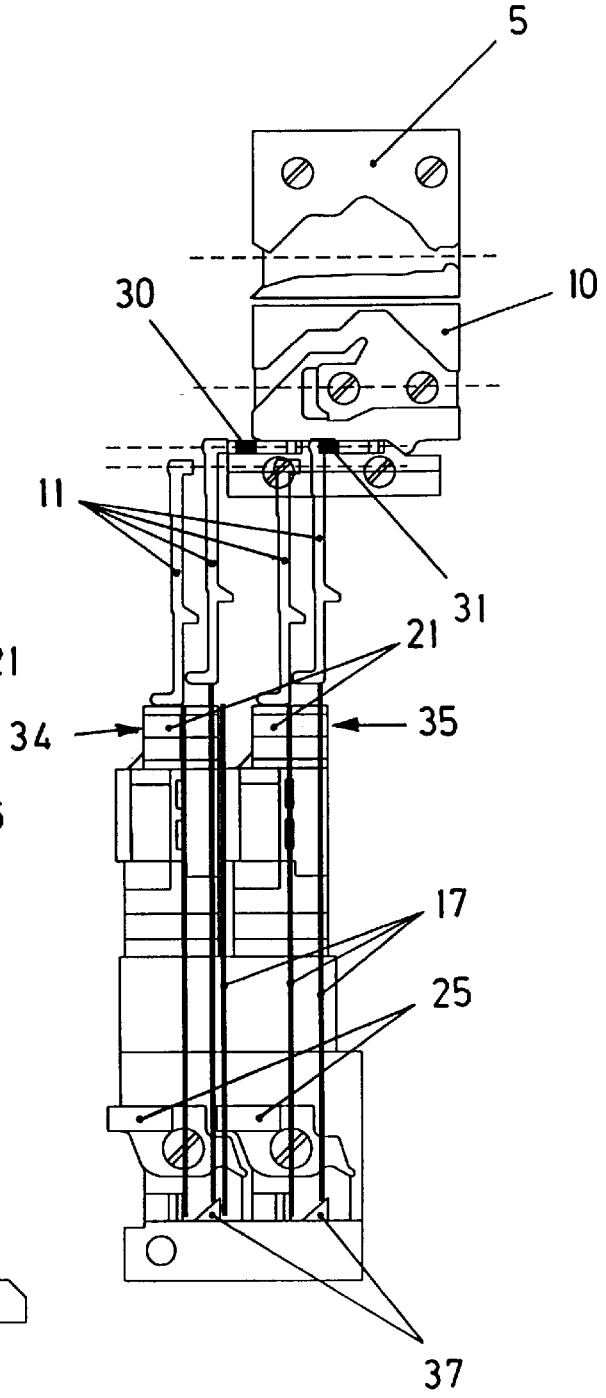

As is shown by FIGS. 5 and 6, the intermediate jack (11) is raised to its high position by the push of the selection jack (17) in two different positions, according to whether the electromagnetic selection acts in the selection system (34) or in the selection system (35) [sic]; the sequence of operation of the electromagnetic selection is produced in the following manner:

The selection jack (17) has two types of movement: a movement of vertical displacement and a movement of radial displacement. So in each cycle the said selection jack (17) is compelled to tilt from the rest position, as seen in FIGS. 1 and 3, toward the armed position, as shown in FIG. 5, at which it is raised by the ramps of the selection cams (25).

In the armed position, the upper face of the selection jack (17) is opposite the magnets of the electromagnetic system (21), which exert on the said jack (17) an attraction force F1 which opposes the force F2 of the elastic foot (22) of the opposed extremity.

The resulting F1 force for its application arm is substantially greater than the resulting F2 force, so that, with no modification of the magnetic fields of the system (21), the jack (17) remains in its armed position at the length of its tangential displacement facing the said system (21). In all this travel, the lower heel (24) remains retracted toward the cylinder (2), being outside the range of the selection cams (25).

The magnetic field of the system (21) can be canceled by a programmable control (36), so that if the magnetic force is canceled at the moment of coincidence of the jack (17) opposite the zone of the magnetic field of the said system (21), the torque action exerted by the elastic foot (22) urges the said jack (17) toward the rest position, with which the heel (24) is separated from the cylinder (2) and is opposed by a ramp (37) of the corresponding selection cam (25), which causes the said jack (17) to rise, and this in its turn pushes the intermediate jack (11) toward the upper position.

Depending on whether the selection jack (17) is released by the selection system (34) or by itself (35), the "selection cancellation" or the "selection of a loaded stitch" result is produced; the ramps (37) of the selection cams (25) are tangentially synchronized with the ramps (30) and (31) of the cam (10) which actuates the intermediate jack (11).

I claim:

1. A system for selecting needles for a circular knitting machine having a series of mobile elements, interrelated with respective stationary elements comprising:

a cylinder having an external contour; multiple longitudinal conduits distributed throughout said external contour;

a needle located in each conduit;

three successive positionable elements located in each conduit which determine a movement of said needle;

one of said three successive positionable elements being an elastically deformable element in the form of a bascule;

two electromagnetic selection systems having two cams which determine an action of said elastically deformable element;

a press cam on which said elastically deformable element rests;

an opposing elastic leg which works in an opposite direction than said elastically deformable element works;

said elastically deformable element being capable of tilting with respect to said two electromagnetic selection systems and of moving in a longitudinal direction when it is free from said two electromagnetic selection systems to determine a moving section of said needle;

a stationary part of the system having operating cams for said needle and each of said three successive positionable elements that determine an action of said positionable elements according to the rotation of said cylinder.

* * * * *